US010240330B2

(12) United States Patent
Tisch et al.

(10) Patent No.: US 10,240,330 B2
(45) Date of Patent: Mar. 26, 2019

(54) COMPACT DRAIN SNAKE

(71) Applicant: BrassCraft Manufacturing Company, Novi, MI (US)

(72) Inventors: David Christopher Tisch, Ferndale, MI (US); Siddharth Subramaniam Chakrapani, Novi, MI (US)

(73) Assignee: Brasscraft Manufacturing Company, Novi, MI (US)

( * ) Notice: Subject to any disclaimer, the term of this patent is extended or adjusted under 35 U.S.C. 154(b) by 333 days.

(21) Appl. No.: 15/169,272

(22) Filed: May 31, 2016

(65) Prior Publication Data

US 2017/0342693 A1 Nov. 30, 2017

(51) Int. Cl.
*E03C 1/302* (2006.01)
*B08B 9/04* (2006.01)

(52) U.S. Cl.
CPC ..... *E03C 1/302* (2013.01); *B08B 9/04* (2013.01)

(58) Field of Classification Search
CPC ..... B08B 9/04; E03C 1/302
See application file for complete search history.

(56) References Cited

U.S. PATENT DOCUMENTS 2,037,104 A * 4/1936 Yohn ..... E03C 1/302 15/104.33
2,245,823 A 6/1941 Rappaport
2,284,939 A 6/1942 Asnard
2,470,225 A 5/1949 Silverman
2,504,391 A * 4/1950 Carson ..... E03C 1/302 15/104.33
4,340,988 A 7/1982 Shames et al.
4,617,693 A * 10/1986 Meyer ..... E03F 9/005 15/104.33
4,706,321 A 11/1987 Kaye
4,763,374 A * 8/1988 Kaye ..... E03F 9/005 15/104.33
4,793,017 A * 12/1988 Kaye ..... E03F 9/005 15/104.33
D307,202 S 4/1990 Moss
4,956,889 A * 9/1990 Kirk ..... E03F 9/005 15/104.33
D311,076 S 10/1990 Kaye
5,018,234 A 5/1991 Meyer et al.
5,056,178 A * 10/1991 Levine ..... E03F 9/005 15/104.33
5,173,984 A * 12/1992 Kaye ..... E03F 9/005 15/104.33
D339,431 S 9/1993 Meyer
5,265,301 A * 11/1993 Irwin ..... E03F 9/005 15/104.33

(Continued)

*Primary Examiner* — Marc Carlson
(74) *Attorney, Agent, or Firm* — Reising Ethington, P.C.

(57) ABSTRACT

A drain snake may include a hollow body having a rearward end and a forward end, and a longitudinal axis extending between the rearward and forward ends. The forward end has a cable feed passage. The drain snake may further include a cable having a first portion coiled in the body around the axis in a location between the rearward and forward ends. The cable has a second portion extending out of the feed passage of the forward end of the hollow body. The drain snake also include a fastener extending through the body at the forward end and into the feed passage to secure and release the cable.

16 Claims, 4 Drawing Sheets

(56) References Cited

U.S. PATENT DOCUMENTS

| | | | | |
|---|---|---|---|---|
| 6,412,136 | B1 * | 7/2002 | Rutkowski | B08B 9/045 15/104.33 |
| 6,898,807 | B2 | 5/2005 | Tash | |
| 8,434,186 | B2 * | 5/2013 | Wildauer | E03F 9/005 15/104.33 |
| 9,234,342 | B1 * | 1/2016 | Beesley | E03F 9/005 |
| 2014/0075661 | A1 * | 3/2014 | Zeng | E03D 9/00 4/255.11 |
| 2017/0284078 | A1 * | 10/2017 | Puzio | B08B 9/045 |
| 2017/0321402 | A1 * | 11/2017 | Thompson | E03C 1/302 |

* cited by examiner

COMPACT DRAIN SNAKE

TECHNICAL FIELD

The present disclosure relates generally to cleaning implements and, more particularly, to a drain snake or auger.

BACKGROUND

Drain snakes or augers may be used to unclog drains or pipes. Typically, a rotatable body is turned via a crank, lever, or motor. Rotational movement may be transferred to an elongated member or "snake" that is extended into the drain or pipe. The rotational motion of the snake may be applied to any foreign debris in a pipe, thereby dislodging or breaking up the debris and unclogging the pipe.

Drain snakes are typically employed in commercial or other more heavy duty applications. Accordingly, many drain snakes may be relatively heavy and typically must be actuated by a motor or cranking mechanism. As such, many drain snakes have been relatively expensive or otherwise impractical for most consumers.

SUMMARY

An illustrative embodiment of a drain snake includes a hollow body having a rearward end and a forward end, and a longitudinal axis extending between the rearward and forward ends. The forward end has a cable feed passage. The drain snake may further include a cable having a first portion coiled in the body around the axis in a location between the rearward and forward ends. The cable has a second portion extending out of the feed passage of the forward end of the hollow body. The drain snake also include a fastener extending through the body at the forward end and into the feed passage to secure and release the cable. In some implementations, a hollow body of a drain auger has a neck extending about the cable feed passage, which defines an outwardly facing concave surface. In other implementations, a drain snake has no crank rotatable relative to another portion of the body and no handle rotatable relative to another portion of the body.

According to another illustrative embodiment, a method of assembling and/or using a drain auger may include providing a hollow body having a rearward end, a forward end having a cable feed passage, and a longitudinal axis extending between the rearward and forward ends. In some implementations, the hollow body has a neck extending about the cable feed passage, with the neck defining an outwardly facing concave surface. In some implementations, the drain snake has no crank rotatable relative to another portion of the body and no handle rotatable relative to another portion of the body. A method may also include positioning a cable within the hollow body, with a first portion of the cable being coiled in the body around the axis in a location between the rearward and forward ends. A second portion of the cable may extend out of the feed passage of the forward end of the hollow body. The method may also include assembling a fastener to the body, the fastener extending through the body at the forward end and into the feed passage to secure and release the cable. Still other implementations are set forth and others will be apparent form the disclosure provided herein.

BRIEF DESCRIPTION OF THE DRAWINGS

The following detailed description of illustrative embodiments and best mode will be set forth with reference to the accompanying drawings, in which.

DETAILED DESCRIPTION OF PRESENTLY PREFERRED EMBODIMENTS

Figure 1A:
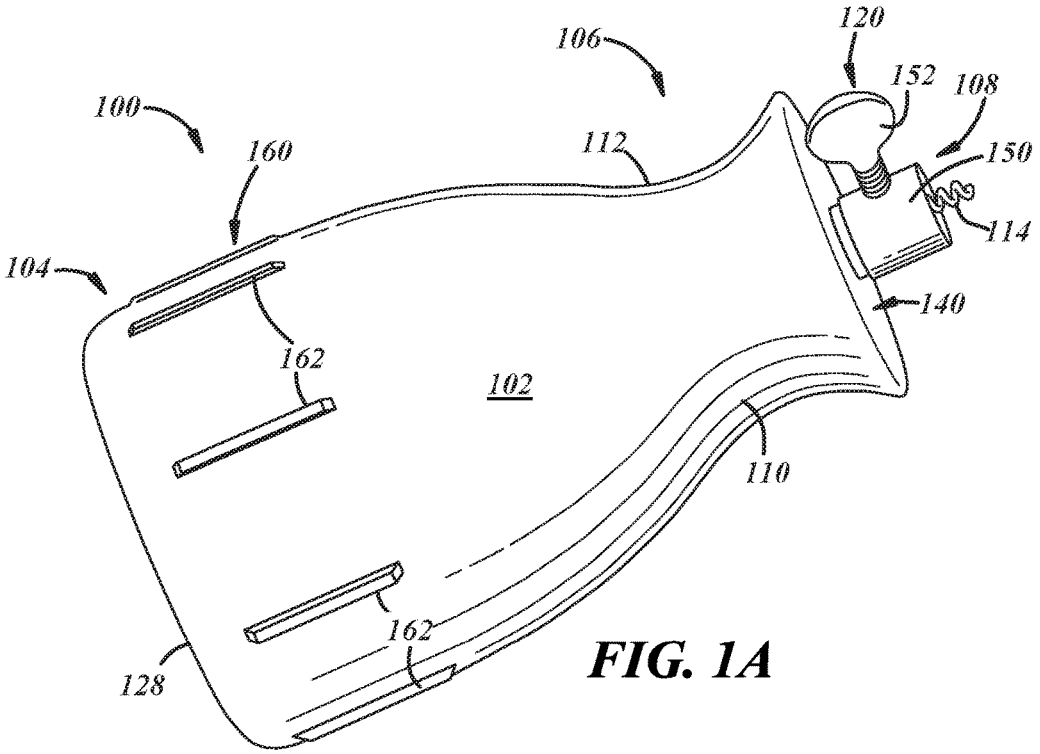
FIG. 1A is a perspective view of a drain snake, according to one illustrative embodiment.

Referring now to FIGS. 1A, 1B, 1C, 2A, and 2B, a drain snake or auger 100 is illustrated and described in further detail. The drain snake 100 may have a hollow body 102 with a rearward end 104 a forward end 106. A cable feed passage 108 (FIG. 2A) extends through the forward end 106. The hollow body 102 defines a longitudinal axis A-A (FIGS. 1B and 2A) extending between the rearward and forward ends 104, 106. The drain snake 100 also includes a cable 114 for directly engaging debris obstructing a pipe or drain. As used herein, the term "cable" may include a wire, a plurality of wires, a flexible rod, or any other suitable flexible member suitable for use in snaking drains.

Generally, the drain snake 100 may be used to unclog a pipe or dislodge an obstruction within a pipe. Initially, the cable 114, which may generally be any elongated flexible member or snake, is extended from the hollow body 102. For example, cable 114 may be fed into a pipe or drain, until the cable 114 reaches an obstruction or clog. The cable 114 may then be fixed with respect to the hollow body 102, such that translational and rotational motion of the hollow body 102 is imparted to the cable 114. The user may urge the cable 114 into and out of the drain in a back-and-forth motion of the hollow body 102, such that a distal end of the cable 114 impacts the obstruction, thereby breaking up, dislodging, and/or grinding up the debris creating the obstruction in the pipe. The user may alternatively or in addition turn, twist, or spin the hollow body 102, thereby applying a turning motion of the cable 114 to the debris. The distal end of the cable 114, to this end, may have a sharp edge, screw, ramp, or cutting device to facilitate breaking up and/or dislodging debris typical of obstructions in pipes or drains.

The cable 114 may have a first portion 116 coiled in the hollow body 102 around the axis A-A, in a location between the rearward and forward ends 104, 106. The cable 114 may also include a second portion 118 extending through and out of the feed passage 108 of the forward end 106 of the hollow body 102.

A fastener 120 (FIGS. 1A, 1B) may also be provided, which extends through the hollow body 102 at the forward end 106 and into the feed passage 108 to secure and release the cable 114. As best seen in FIGS. 1A, 1B, 2A, and 2B, the fastener 120 may include a screw collar 150 and a thumbscrew or screw 152 extending through the screw collar 150 transversely into the feed passage 108. The screw 152 may be threaded, and received in a corresponding threaded aperture allowing the screw 152 to be tightened against the cable 114, thereby selectively fixing the cable 114 both translationally and rotationally with respect to the hollow body 102.

The hollow body 102 may have a neck 110 generally extending about the cable feed passage 108. The neck 110 may be narrowed with respect to other portion(s) of the hollow body 102. The neck 110, as best seen in FIGS. 1A, 1B, 2A, and 2B, may define an outwardly facing concave surface 112. The narrowed neck 110 and/or outwardly facing concave surface 112 may generally facilitate handling of the hollow body 102 and/or drain snake 100. For example, the relatively narrow neck 110 may be more easily grasped by the hand of a user. Additionally, as will be discussed further below, the neck 110 and/or concave surface 112 may focus a radially inwardly applied force, e.g., by a hand grasping the hollow body 102, to a fixed position with respect to the hollow body 102.

The hollow body 102 may be formed of any material and via any forming process that is convenient. In some implementations, the hollow body 102 may be of multiple piece construction, e.g., assembled from two separately formed halves or portions. The two portions may be joined together with a mechanical fastener such as a screw, or may be sonic welded, glued, or bonded together, merely as examples. In other examples, the hollow body 102 may be generally formed as a monolithic single piece, e.g., in a 3-dimensional printing process, or any other process capable of forming the hollow body 102 in one piece. The hollow body 102 may be molded of a composite, nylon, or plastic material, which may be relatively lightweight and/or inexpensively produced. Alternatively, the hollow body 102 may be stamped or cast of a metallic material, e.g., aluminum or steel, merely as examples.

The drain snake 100 may have a relatively small number of components, e.g., consisting solely or essentially of the hollow body 102, the cable 114, and the fastener 120. The small number of parts and/or simplified construction of the hollow body 102, e.g., by forming of a single piece, may generally reduce manufacturing and/or assembly costs of the drain snake 100.

The hollow body 102 may have a rear wall 128 at the rear end 104, which extends transversely with respect to the axis A-A. The hollow body 102 also may have a front wall 130 at the front end 106, including a radially outer portion 132 extending transversely with respect to the axis A-A and a radially inner portion 134 extending parallel to the axis A-A. The radially inner portion 134 has the feed passage 108 extending through a radially central portion thereof, which may receive the second portion of the cable 118. The hollow body 102 may also have a sidewall 136 extending between the rear and front walls 130, 128 and extending beyond the front wall 130 to establish a skirt 138 that at least partially defines an open reservoir 140 at the front end 106.

Figure 2A:
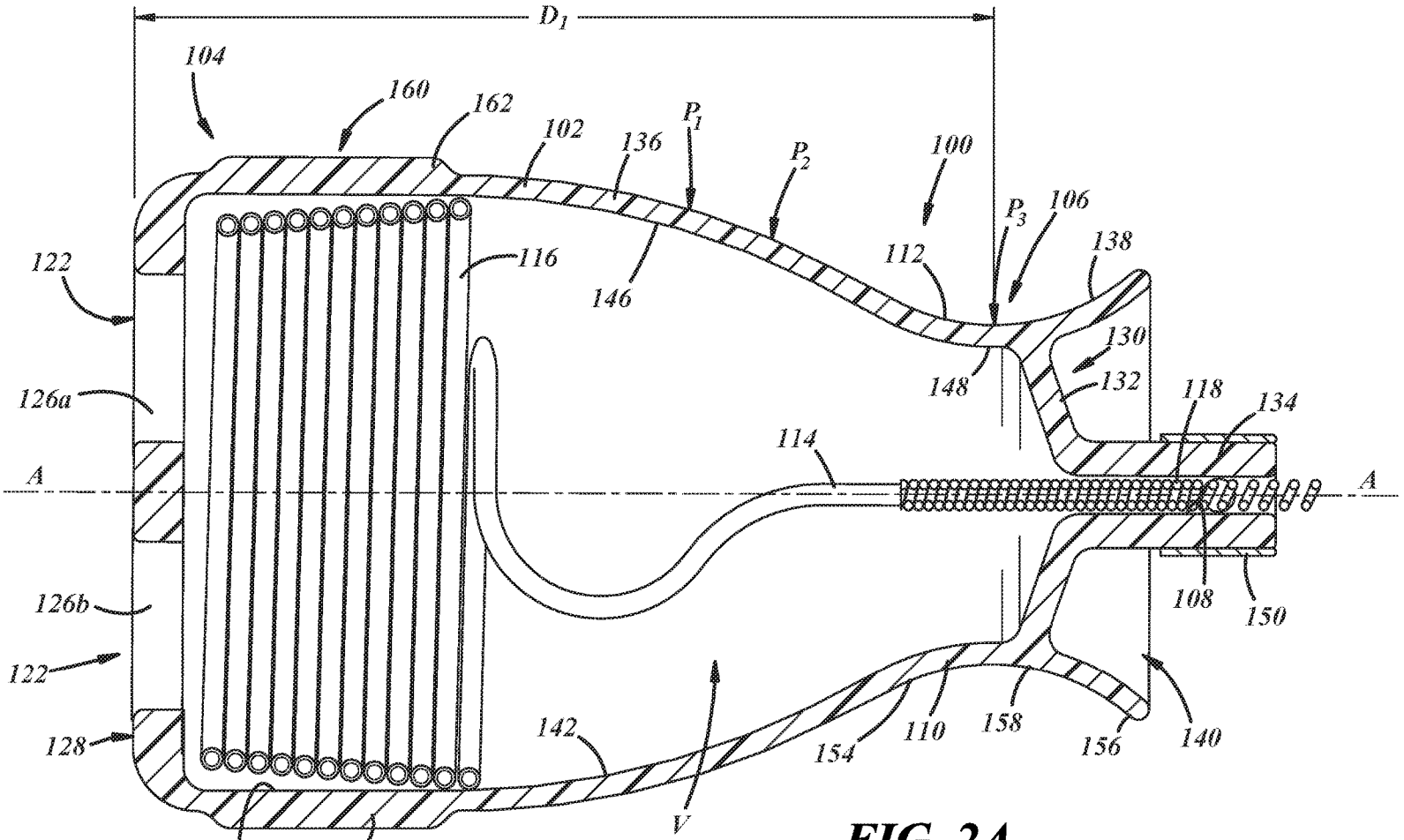
FIG. 2A is a side cross-sectional view of the drain snake of FIGS. 1A-1C, according to one illustrative embodiment.
Figure 2B:
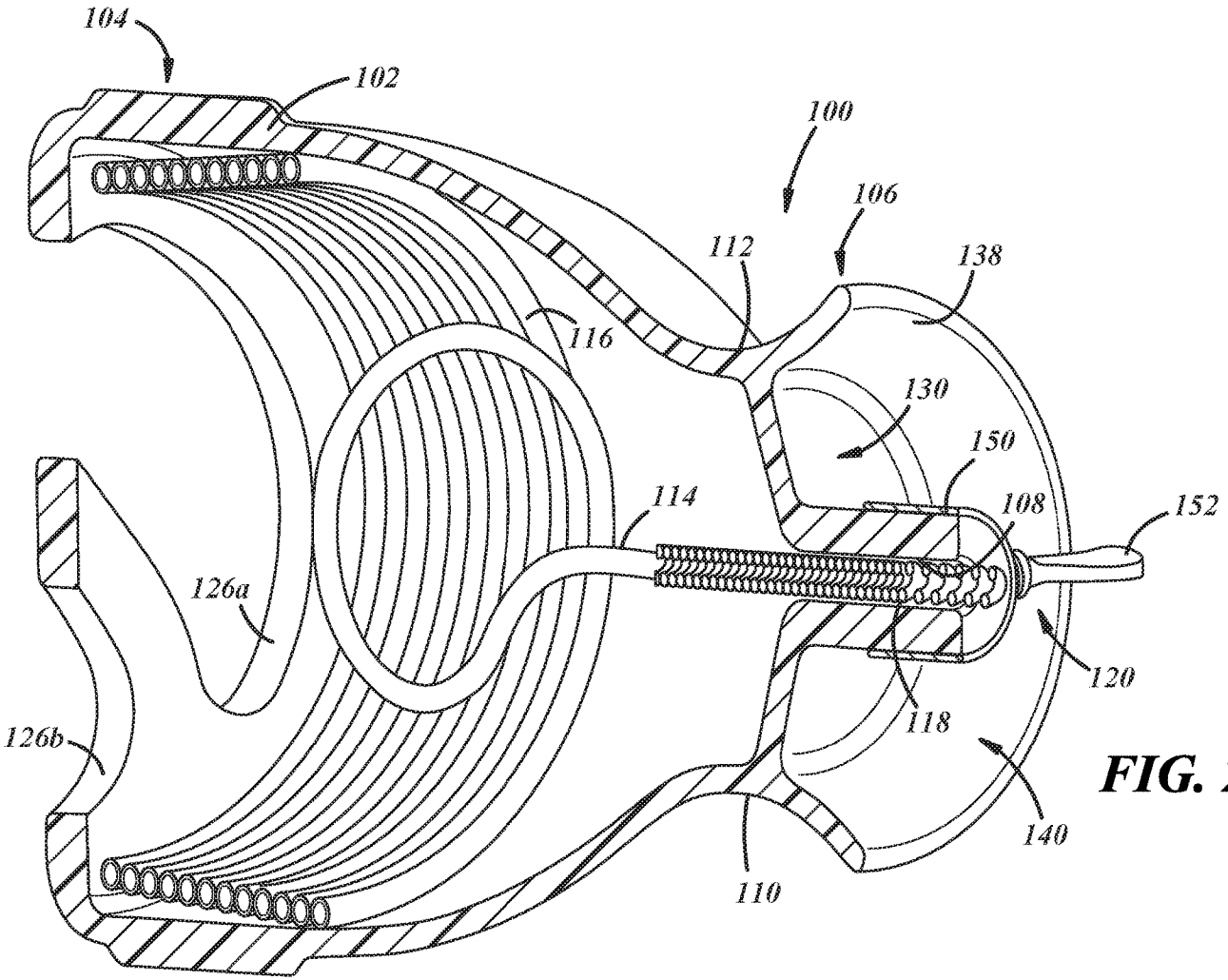
FIG. 2B is a perspective cross-sectional view of the drain snake of FIGS. 1A-1C and 2A, according to one illustrative embodiment.

The hollow body 102 may have an interior configured to contain at least the first portion of the cable 114. For example, the hollow body 102 may have an inside surface 142, and a cylindrical portion 144 adjacent the rear end 104. An excurvate (i.e., with respect to the centerline defined by axis A-A) portion 146 of the hollow body 102 may extend axially from the cylindrical portion 144 and may decrease in diameter. A diameter of the excurvate portion 146, for example, decreases from a position $P_1$ to a smaller diameter at position $P_2$ (further from the rear wall 128), as shown in FIG. 2A. An incurvate (with respect to the centerline defined by axis A-A) portion 148 of the hollow body 102 extends axially from the excurvate portion 146. While the excurvate portion 146 of the hollow body 102 is defined by a relatively significant decrease in diameter, the incurvate portion 146 may decrease in diameter to a lesser degree, until the diameter is constant or, as shown in the Figures, increasing at forward end 106. For example, as best seen in FIGS. 2A and 2B, the incurvate portion 148 generally curves or flares radially outwardly with respect to the axis A-A at the forward end 106.

The rear wall 128, cylindrical portion 144, excurvate portion 146, and incurvate portion 148 may cooperate to form an interior volume V of the hollow body 102. The volume V may be, as shown in the Figures, substantially closed with the exception of apertures provided for drainage (e.g., apertures 126*a*, 126*b* described further below) and passage 108.

Figure 1B:
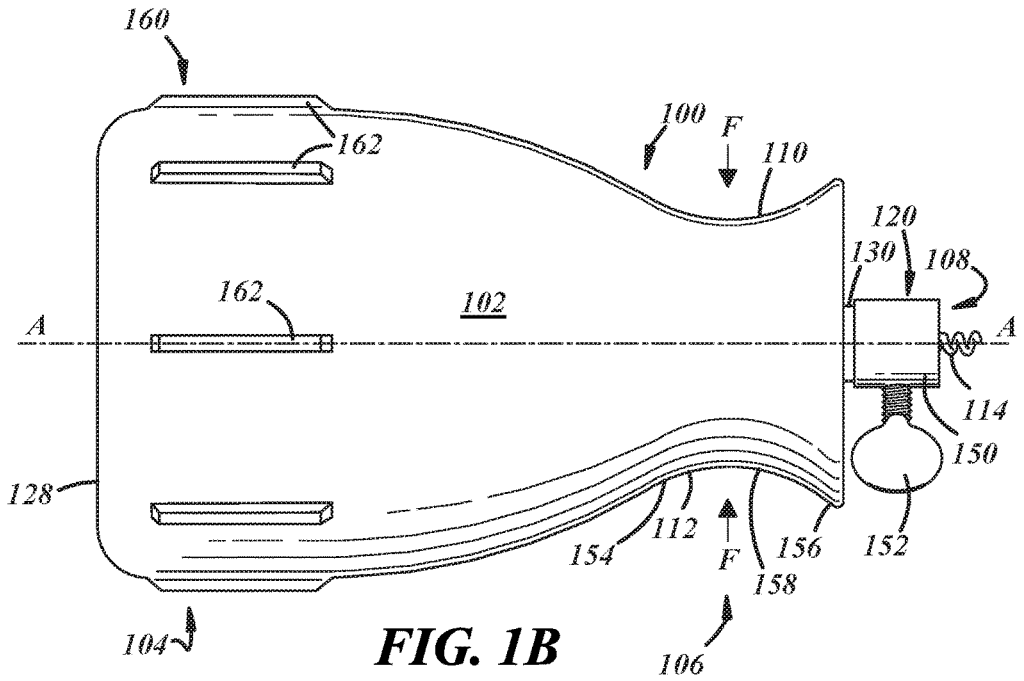
FIG. 1B is a side view of the drain snake of FIG. 1A, according to one illustrative embodiment.
Figure 1C:
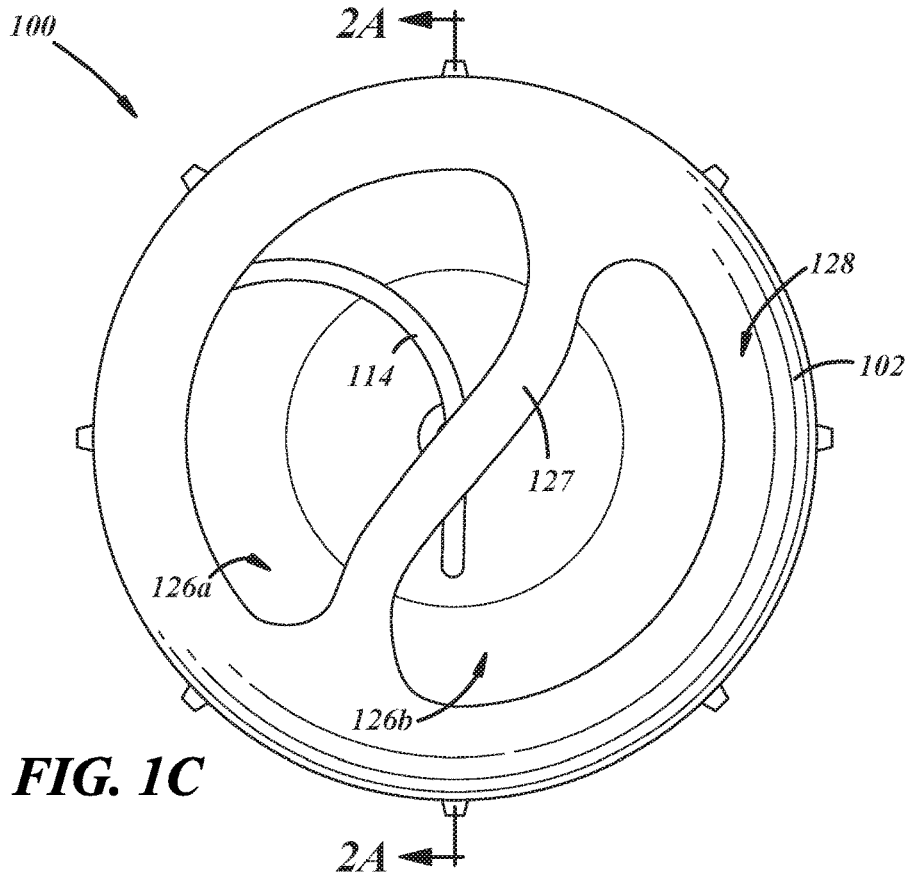
FIG. 1C is a rear view of the drain snake of FIGS. 1A and 1B, according to one illustrative embodiment.

While there are no restrictions on what size the hollow body 102 may be, in some examples the hollow body 102 may generally lend itself to being handled by hand by being relatively small and lightweight. Moreover, the hollow body 102 may be shaped in a manner that also facilitates use of the drain snake 100 by hand, or even with a single hand. For example, the rearward end 104 of the hollow body 102 may facilitate grasping the hollow body 102 with one hand by a user. As best seen in FIGS. 1C, 2A, and 2B, the hollow body 102 includes two recesses 122 which extend axially inwardly with respect to the axis A-A from the rear of the snake 100. The recesses 122 may, as shown in the Figures, extend entirely through the rear wall 128 of the hollow body 102, thereby forming apertures 126*a*, 126*b* (collectively, 126) extending into an interior of the hollow body 102. Alternatively, the recesses 122 may form depressions or undulations in the rear wall 128 that are sufficiently large to allow finger grip of the hollow body 102, without extending entirely through the rear wall 128. In any case, the finger recesses 122 may generally lend themselves to being grasped by a single hand of a user. For example, the user may rest the base or palm of one hand upon an outer surface of the hollow body 102, e.g., on or adjacent the rear wall 128, with one or more fingers of the hand being extended into one of the recesses 122. As such, the recesses 122 help the hand maintain a fixed position both rotationally and translationally with respect to the hollow body 102. Accordingly, the user may better grip the hollow body 102 for urging the snake into/out of a pipe being unclogged, and/or rotating the snake within the pipe. The finger recesses 122 may, as best seen in FIG. 1C, establish a finger grip 127 that may intersect the axis A-A and may be generally wave-shaped.

The hollow body 102 may also have an outer grip 160 adjacent or at the rearward end 104 configured to facilitate grip of the hollow body 102. For example, as best seen in FIGS. 1A, 1B, 2A, and 2B, a plurality of fins 162 may be provided. The fins 162 may provide grip, e.g., to a palm of hand while one or more fingers are engaged in the recesses 122. Alternatively or in addition, the outer grip 160 may include recesses, a high friction surface such as a knurled surface, rubber grip, or the like to enhance the user's grip of the generally cylindrical rear end 104.

The forward end 106 of the hollow body 102 may also facilitate grip by a user, e.g., with the opposite hand of that grasping the rear end 104, or solely with one hand. As best seen in FIGS. 1B and 2A, the outwardly facing concave surface 112 may include a forward portion 156 and a rearward portion 154, with a midpoint or valley 158 disposed therebetween. The forward portion 156 generally increases in outer diameter from the midpoint 158 in a forward direction, while the rearward portion 154 increases in outer diameter from the midpoint 158 in a rearward direction. Accordingly, the neck 110 generally defines a valley-like contour that facilitates a stable grip of the forward end 106 of the hollow body 102. The outwardly facing concave surface 112 may be configured to guide a force F (see FIG. 1B) applied radially inwardly upon the neck 110 to a fixed axial position P with respect to the rearward end 104 of the hollow body 102. In other words, as a user grasps the forward end 106 in the region of the neck 110, the concave surface 112 will generally "guide" the user's hand to a fixed position axially with respect to the hollow body 102. As best seen in FIG. 2A, the concave surface 112 generally stably supports grip at a narrow portion of the hollow body 102, which is at a generally fixed position $P_3$. The fixed position is shown positioned at a distance Di from rear wall 128. The fixed axial position $P_3$ may generally correspond to the midpoint 158 of the outwardly facing concave surface 112.

As noted above, the relatively simple construction of the drain snake 100 may facilitate assembly and production. Additionally, the drain snake 100 generally has no crank that is rotatable relative to another portion of the hollow body 102, and no handle rotatable relative to another portion of the hollow body 102. Rather, the drain snake 100 may be turned via the hollow body 102 itself. Moreover, the finger recesses 122, outer grip 160, finger grip 127, and/or neck 110 may facilitate manual grip of the hollow body 102 by the user.

The rearward end 104 of the hollow body 102 may be generally flat, as best seen in FIGS. 1B and 2A. The flat rearward end 104 may generally facilitate resting the drain snake 100 flat on the rearward end 104, i.e., in a generally vertical position. Additionally, the rear wall 128 may establish a rearmost surface of the hollow body 102, with no handle or other protuberances extending or protruding axially away from the rear wall 128. Moreover, where one or more apertures, e.g., apertures 126, are provided in the rear wall 128, resting of the drain snake 100 upon the rear wall 128 may facilitate draining of an interior of the drain snake 100, e.g., to allow any residual liquid accumulated on the cable 114 during use to drain downward and out of the drain snake 100.

Figure 3:
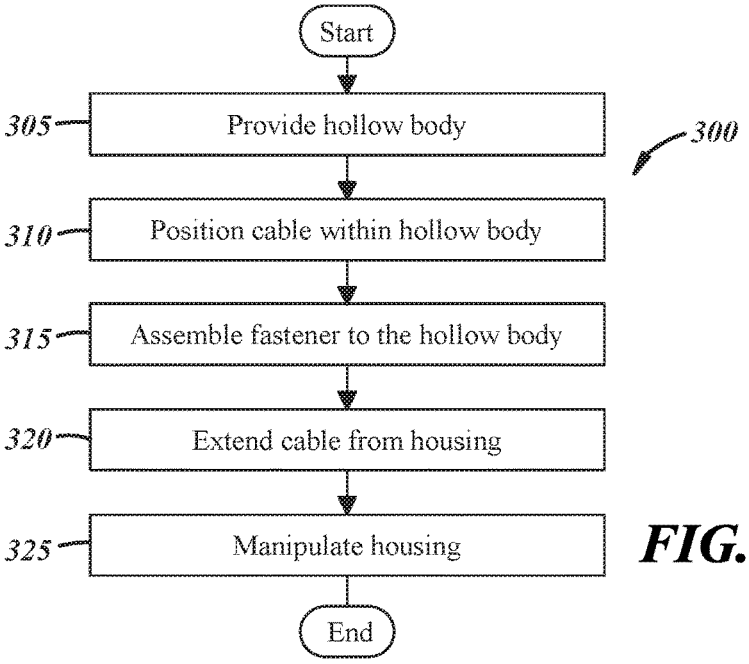
FIG. 3 is a process flow diagram for a method of assembling and/or using a drain snake, according to one illustrative embodiment.

Turning now to FIG. 3, a process 300 of assembling and/or using a drain snake is described in further detail, according to one illustrative embodiment. Process 300 may begin at block 305, where a hollow body 102 is provided having a rearward end, and a forward end having a cable feed passage. For example, with general reference to FIGS. 1A-2B, the hollow body 102 may have a forward end 106 and rearward end 104, and a longitudinal axis extending between the rearward and forward ends 104, 106, as described above. In some implementations, a neck 110 extends about the cable feed passage 108, and defines an outwardly facing concave surface 112 configured to facilitate grip of the hollow body 102.

Proceeding to block 310, a cable 114 may be positioned within the hollow body 102. For example, a cable 114 having a first portion 116 coiled in the hollow body 102 may be inserted and coiled within an interior volume V of the hollow body 102, as described above. The cable 114 may have a second portion 118 extending out of the feed passage 108 of the forward end 106 of the hollow body 102. Process 300 may then proceed to block 315.

At block 315, a fastener may be assembled to the hollow body. For example, as described above a fastener 120 may extend through the hollow body 102 at the forward end 106 and into the feed passage 108 to engage the second portion 118 of the cable 114. Accordingly, the fastener 120 may secure and release the cable 114.

Proceeding to block 320, the cable may be extended from the hollow body 102. For example, as described above the second portion 118 of the cable 114 may be extended out of the interior of the hollow body 102, e.g., until the elongated cable 114 reaches an obstruction or debris within a pipe. Process 300 may then proceed to block 325.

At block 325, the cable may be fixed to the hollow body. For example, the fastener 120 may be tightened such that it secures the cable 114 with respect to the hollow body 102. The hollow body 102 and cable 114 may thus be substantially fixed rotationally and translationally together.

Proceeding to block 330, the housing 102 may be manipulated by the user to effect motion in the cable to dislodge, grind, break up, or otherwise remove an obstruction or debris in the pipe. For example, the user may turn or spin the hollow body 102. Alternatively or in addition the user may move the hollow body 102 back and forth, thereby impacting a distal end of the cable 114 with the obstruction/debris.

Drain snakes disclosed herein may, in contrast to known drain augers, be generally easy to use and less costly to produce. The ease of use and relatively lesser cost may result, for example, from the relatively simple, lightweight construction and lack of a crank apparatus such as a lever, crank, or motor. Accordingly, the illustrative drain snakes or augers disclosed herein may be well within the skill level and budget of homeowners, renters, and other non-commercial consumers.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A drain snake, comprising:

a hollow body including:

a rearward end, a forward end having a cable feed passage, and a longitudinal axis extending between the rearward and forward ends;

a cable including:

a first portion coiled in the body around the axis in a location between the rearward and forward ends, and a second portion extending out of the feed passage of the forward end of the hollow body; and a fastener extending through the body at the forward end and into the feed passage to secure and release the cable, wherein the rearward end of the hollow body includes no handle protruding away therefrom, has finger recesses to establish a finger grip, and is flat to facilitate resting of the drain snake thereon.

2. The drain snake of claim 1, wherein the drain snake is crankless, such that the drain snake has no crank rotatable relative to another portion of the body and no handle rotatable relative to another portion of body.

3. The drain snake of claim 1, wherein the finger recesses include apertures.

4. The drain snake of claim 1, wherein the finger grip is wave-shaped.

5. The drain snake of claim 1, wherein the hollow body includes:

a cylindrical portion adjacent the rearward end, an incurvate portion extending away from the cylindrical portion and decreasing in diameter, and an excurvate portion extending away from the excurvate portion and continuing to decrease in diameter and then increasing in diameter to flare outwardly at the forward end.

6. The drain snake of claim 5, wherein the forward end includes a neck extending about the cable feed passage, the neck defining an outwardly facing concave surface.

7. The drain snake of claim 6, wherein the outwardly facing concave surface is configured to guide a force applied radially inwardly upon the neck to a fixed axial position with respect to the rearward end of the hollow body.

8. The drain snake of claim 6, wherein the outwardly facing concave surface includes forward and rearward portions and a midpoint disposed therebetween;

wherein the forward portion increases in outer diameter from the midpoint in a forward direction, and the rearward portion increases in outer diameter from the midpoint in a rearward direction.

9. The drain snake of claim 8, wherein the outwardly facing concave surface is configured to guide a force applied radially inwardly upon the neck to a fixed axial position with respect to the rearward end of the hollow body, the fixed axial position corresponding to the midpoint of the outwardly facing concave surface.

10. The drain snake of claim 1, wherein the fastener includes a screw collar and a screw extending through the screw collar transversely into the feed passage.

11. The drain snake of claim 1, consisting essentially of the hollow body, the cable, and the fastener.

12. The drain snake of claim 1, wherein the drain snake has no handle rotatable relative to another portion of the body.

13. The drain snake of claim 1, wherein the rearward end of the hollow body defines a plurality of apertures configured to facilitate gripping the rearward end and drainage of the hollow body.

14. A drain snake, comprising:

a hollow body including:

a rearward end, a forward end having a cable feed passage, and a longitudinal axis extending between the rearward and forward ends;

a cable including:

a first portion coiled in the body around the axis in a location between the rearward and forward ends, and a second portion extending out of the feed passage of the forward end of the hollow body, and wherein the hollow body includes:

a rear wall at the rearward end extending transversely with respect to the axis, a front wall at the forward end including a portion extending transversely with respect to the axis and another portion extending parallel to the axis and having the feed passage with the second portion of the cable extending therethrough, and a sidewall extending between the rear and front walls and extending beyond the front wall to establish a skirt that at least partially defines an open reservoir at the forward end.

15. The drain snake of claim 14, wherein the rear wall establishes a rearmost surface and includes no handle protruding away therefrom.

16. A drain snake, comprising:

a hollow body including:

a rearward end includes no handle protruding away therefrom, has finger recesses to establish a finger grip, and is flat thereby facilitating resting the drain snake thereon, a forward end having a cable feed passage and an open reservoir, and a longitudinal axis extending between the rearward and forward ends; and a cable including:

a first portion coiled in the body around the axis in a location between the rearward and forward ends, and a second portion extending out of the feed passage of the forward end of the hollow body.

* * * * *